United States Patent [19]

Faddis et al.

[11] Patent Number: 4,616,564

[45] Date of Patent: Oct. 14, 1986

[54] MODULAR OFFSET LITHOGRAPHIC PRINTING TOWER

[75] Inventors: Terry N. Faddis; Glen H. Ensminger, both of Emporia, Kans.

[73] Assignee: Didde-Glaser, Inc., Emporia, Kans.

[21] Appl. No.: 194,373

[22] Filed: Oct. 6, 1980

Related U.S. Application Data

[63] Continuation of Ser. No. 969,585, Dec. 14, 1978, abandoned.

[51] Int. Cl.[4] ..... B41F 7/02; B41F 13/00

[52] U.S. Cl. ..... 101/143; 101/218; 101/220

[58] Field of Search ..... 101/136–145, 101/177–185, 216–225, 229

[56] References Cited

U.S. PATENT DOCUMENTS

| | | | |
|---|---|---|---|
| 845,586 | 2/1907 | Sheehan | 101/141 |
| 1,782,608 | 11/1930 | Fulk | 101/180 |
| 1,855,212 | 4/1932 | Adsit | 101/224 |
| 1,952,028 | 3/1934 | Hehle | 101/178 |
| 1,968,849 | 8/1934 | Morse | 101/144 |
| 2,146,586 | 2/1939 | Meisel | 101/139 |
| 2,158,701 | 5/1939 | Jirousek | 101/137 |
| 2,283,003 | 5/1942 | Frostad | 101/182 |
| 2,337,386 | 12/1943 | Grupe | 101/216 |
| 2,598,414 | 5/1952 | Morse | 101/185 |
| 2,690,121 | 9/1954 | Auerbacher | 101/181 |
| 2,731,910 | 1/1956 | Gruver | 101/143 |
| 3,252,415 | 5/1966 | Crawford | 101/181 |
| 3,262,384 | 7/1966 | Dubuit | 101/217 |
| 3,286,622 | 11/1966 | Mestre | 101/144 |
| 3,470,816 | 10/1969 | Plecha | 101/216 |
| 3,598,050 | 8/1971 | Thompson | 101/216 |
| 3,610,144 | 10/1971 | Woessner | 101/216 |
| 3,664,261 | 5/1972 | Dahlgren | 101/177 |
| 4,046,070 | 9/1977 | Halley | 101/216 |

FOREIGN PATENT DOCUMENTS

| | | | |
|---|---|---|---|
| 5573 | of 1915 | United Kingdom | 101/216 |
| 600973 | 4/1948 | United Kingdom | 101/183 |
| 703452 | 2/1954 | United Kingdom | 101/178 |
| 741105 | 11/1955 | United Kingdom | 101/216 |

*Primary Examiner*—Clyde I. Coughenour

*Attorney, Agent, or Firm*—Schmidt, Johnson, Hovey & Williams

[57] ABSTRACT

A low cost, variable, modular, web-fed offset lithographic printing unit or tower is disclosed which allows significant economies in production and maintenance, and can be easily and quickly modified in the field using interchangeable modules so as to vary printing characteristics. The printing tower, in the straight-through variable perfector form thereof, is preferably provided with a printer module having upper and lower web-printing blanket rollers; in addition, the tower has corresponding upper and lower inker modules for the respective blanket rollers. The upper inker module is mounted for pivotal movement about a horizontal axis so that it can be shifted between a normal inking position over the printer module to a retracted, printer module-clearing position allowing removal and/or replacement of the printer module by essentially vertical shifting of the printer module. By virtue of modular construction, the supporting sidewalls for the separate tower modules can be of varying thicknesses sufficient for support of the intended module components, and thus the necessity of uniformly thick, expensive tower sidewalls, and the manufacturing problems associated therewith, is completely avoided. In addition, the modular tower permits mass production of certain universally used modules to lower costs, and also allows the user to stock extra and/or different tower modules to facilitate field repair or alteration of the tower.

4 Claims, 7 Drawing Figures

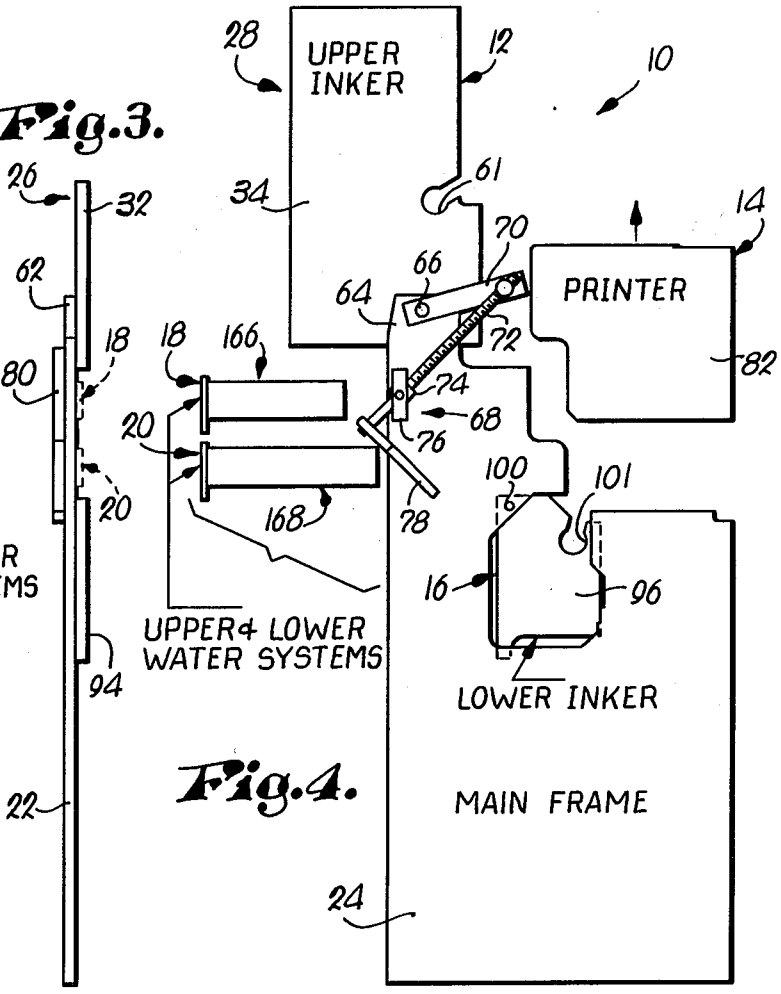
Fig.4.
Fig.3.
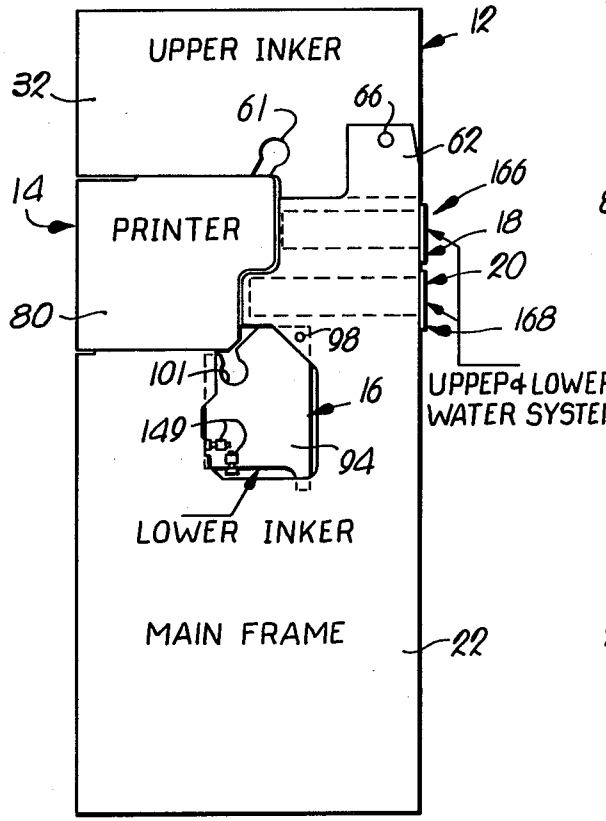
Fig.1.
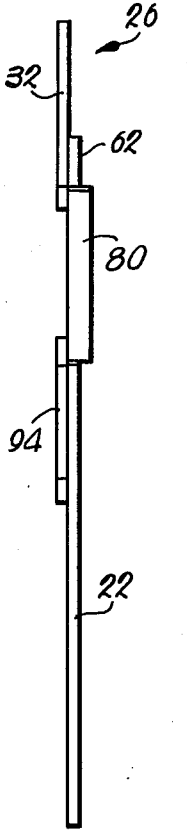
Fig.2.

MODULAR OFFSET LITHOGRAPHIC PRINTING TOWER

This is a continuation of application Ser. No. 969,585, filed on Dec. 14, 1978, now abandoned.

BACKGROUND OF THE INVENTION

1. Field of the Invention

The present invention is broadly concerned with web-fed offset lithographic printing towers of modular construction. More particularly, the invention is concerned with a modular printing tower which is especially designed for ease of manufacture, repair and maintenance, and which can be easily and quickly varied in the field by removal and replacement of the printer module associated therewith, so as to vary printing characteristics as desired. Interchangeability of tower modules allows a user to maintain, at relatively lost cost, spare and/or different modules for convenience purposes and to increase the versatility of the tower.

2. Description of the Prior Art

Traditionally, complete web-fed offset lithographic printing presses are composed of a series of aligned towers through which a continuous web of paper is fed for printing purposes. In the case of color printing for example, a separate tower is used for each color so as to give the final printed material a multicolor effect. Also, each press tower is normally provided with a printer section, one or more inking units, and associated water systems.

For the most part, web-fed press towers of the type described above have been produced on an individual basis. This has generally involved fabricating sidewalls and other necessary support structure, and installing the necessary rollers and other mechanism associated with the tower. In this connection, the practice has been to employ relatively thick, integral tower sidewalls. These sidewalls are carefully bored for receiving roll mounts at various locations, as well as being configured for other purposes. As can be appreciated, such a mode of construction presents a number of problems. First, use of integral sidewalls makes it necessary to discard the entire sidewall in the event that a small error is made in placement of a single aperture therethrough, inasmuch as roll placement and orientation are critical to tower performance. Hence, a single mistake of this nature in fabrication makes it necessary to scrap an entire sidewall, even if it is otherwise complete and perfect. Second, even though only a portion of the overall tower (normally the printer section) requires relatively thick sidewalls for adequate support, use of integral sidewalls means, as a practical matter, that the entire sidewall must be of the maximum thickness. This in turn greatly increases the material costs, without an attendant significant increase in structural integrity or utility of the tower.

Although towers having interchangeable printer sections have been proposed in the past, for the most part these units have been very complex and time consuming to use and modify. Certain known prior towers have employed printer sections which can be shifted horizontally for removal from the tower. Without known exception however, this type of tower has required specialized guide and motive structure for movement of the printer section, along with mechanism for shifting adjacent rollers and/or gears for accommodating a replacement printer section. All of the features have made variable presses extremely expensive and difficult to use in the field. In fact, these difficulties have been so formidable as to preclude production of certain types of variable towers, i.e., so-called variable straight through perfector towers having upper and lower web-contacting and printing blanket rolls for receiving a web traveling along a generally horizontal path of travel. The complexity of such straight through perfector towers has made it impossible to provide an effective capacity for varying the printing section of the tower, even though from a utility standpoint such a feature would be highly advantageous.

SUMMARY OF THE INVENTION

The problems described above are in large measure solved by the present invention. In its broadest aspects, the tower of the invention is of fully modular construction and is so constructed as to allow easy and quick maintenance, removal and/or replacement of the respective tower modules. In one particularly important aspect, the uppermost inker module of the towar is mounted for pivotal movement about a generally horizontal axis between a normal inking position wherein the form roller of the inker is in contact with the adjacent plate roller of the printer section, to a retracted, printer section-clearing position. In this orientation, the printer section can be shifted essentially vertically out of the tower and therefore use can be made of conventional overhead support rails provided in print shops. In addition, pivoting of the upper inker module to its recessed position allows easy replacement and/or repair of the rolls and other mechanism provided therein.

The fully modular construction of the tower of the instant invention also allows use of supporting sidewalls for the respective modules which are designed for maximum support and structural integrity without undue expense or waste of materials. That is to say, the printer section provided with the tower hereof is the heaviest unit requiring the most rigid support. Accordingly, the sidewalls provided with this unit are relatively thick to provide the necessary support. However, the remainder of the tower sidewalls, and particularly the main upstanding portions thereof, can be fabricated from materials of lesser thickness so as to minimize construction costs. It will of course be understood that in other tower configurations, structural demands may make it necessary to use sidewalls of varying thicknesses at different locations, and such eventualities are within the scope of the present invention as well.

The modular construction of the tower also eliminates one of the most troublesome problems associated with the manufacture of web-fed towers, i.e., the necessity of scrapping an entire tower sidewall in the event of a single error in tolerances or placement of an aperture therethrough. Specifically, each of the modules can be fabricated separately and therefore any fabrication mistakes are limited to a particular module, as opposed to an entire tower sidewall. In this way scrap is reduced and labor costs are considerably lowered. Also, the inherently adjustable nature of the tower modules allows compensation for any tolerance errors made during manufacture.

Finally, the particular modular tower configuration disclosed herein allows fabrication and use of a truly variable, straight through perfector tower. Use of a pivotally mounted upper inker, along with a removable printer section which can be shifted vertically, are chiefly responsible for the ability to provide a practical, variable straight through perfector tower.

BRIEF DESCRIPTION OF THE DRAWINGS

FIG. 1 is an essentially schematic side view of a tower in accordance with the invention, illustrating the gear side of the tower;

FIG. 2 is an end elevational view of the sidewall of the tower illustrated in FIG. 1, viewing from the left hand side of the FIG. 1 illustration;

FIG. 3 is an end elevational view of the sidewall of the tower illustrated in FIG. 1, viewing from the right hand end of FIG. 1;

FIG. 4 is an essentially schematic, exploded side view illustrating the upper inker of the tower in its retracted, printer section-clearing position, with the printer section shown as being vertically shifted from the tower, and with the upper and lower water systems laterally removed from the tower;

DESCRIPTION OF THE PREFERRED EMBODIMENT

Figure 5:
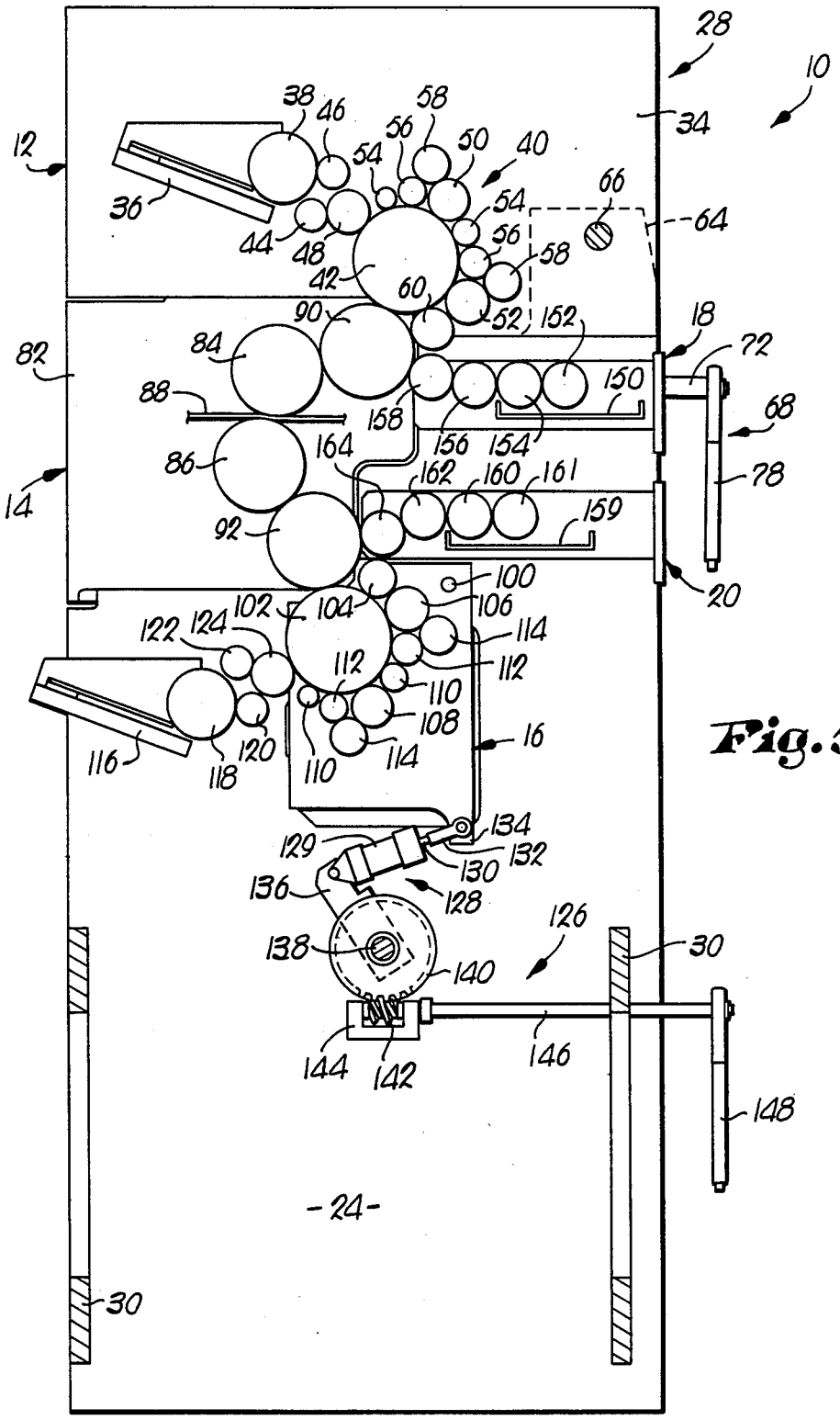
FIG. 5 is an essentially schematic view of the interior of the tower illustrating the various rollers associated therewith, and the modules of the tower.

Turning now to the drawings, a tower 10 of modular construction is illustrated which broadly includes an upper inker section 12, a printer section 14, a lower inker section 16, and upper and lower water delivery systems respectively numbered 18 and 20. A pair of upright, irregularly shaped main frame wall portions 22 and 24 support the tower modules; and as will be described in more detail hereinafter, the portions 22, 24, and the corresponding supporting sidewalls of the various tower modules, cooperatively define overall, upright, spaced sidewalls 26 and 28 for the tower 10. These sidewalls 26, 28 support a series of elongated, cylindrical, axially rotatable rollers disposed for rotation about respective horizontal axes, and are maintained in spaced relationship and rigidified by conventional means such as cross braces 30 (see FIG. 5) extending between the portions 22, 24.

In more detail, upper inker 12 includes a pair of spaced sidewalls 32, 34 which are of generally rectangular configuration, and, in the embodiment shown, are formed of ¾ inch thick metal plate. These sidewalls 32, 34 support the components of the inking system which include an ink fountain 36, an ink roller 38 disposed partially within the fountain 36, and a roller train 40 including a relatively large form roller 42 having a resilient periphery. The train 40 includes a pair of ductor rollers 44, 46 which are shiftable in an oscillating fashion between ink roller 38 and hard, metallic vibrator roller 48, the latter being in tangential rolling contact with form roller 42. Additional vibrator rollers 50, 52 are similarly disposed around form roller 42 in spaced relationship to one another. Two sets of rider rollers each including three rollers of successively larger diameter 54, 56 and 58 are associated with each vibrator roller 50, 52 as illustrated. An additional rider roller 60 is in tangential rolling contact with form roller 42 adjacent the lowermost vibrator roller 52. Form roller 42 is mounted within respective keyhole slots 61 provided in the walls 32, 34 for ease of replacement of the roller.

The purpose of roller train 40 is to deliver ink to the form roller 42 and to smooth out the ink thereon in a manner to eliminate all plate-derived latent images before a reinked portion of the form roller moves back into ink-transferring relationship with the plate roller (to be described hereinafter) associated with the adjacent printer section 14. A complete description of the structure and operation of inker section 12 (and also of section 16 inasmuch as the inker sections are substantially identical) can be found in copending U.S. patent application Ser. No. 802,890 entitled "Planetary Inker For Offset Printing Press", filed June 2, 1977; accordingly, the disclosure of this application is hereby incorporated by reference herein.

Referring specifically to FIGS. 1, 2 and 5, it will be seen that upper inker section 12 is pivotally mounted to the tower 10 for shifting movement thereof as desired about a generally horizontal axis. Specifically, the main frame wall portions 22, 24 are provided with upstanding tabs 62, 64, and the respective sidewalls 32, 34 of the inker section 12 are disposed inwardly of and adjacent to the respective corresponding tabs 62, 64. An elongated pivot shaft 66 is journaled to the respective tabs 62, 64 and serves to pivotally support the sidewalls 32, 34, and thereby allows pivoting movement of the entire section 12 about the generally horizontal axis defined by the shaft 66. In addition, mechanism 68 is mounted on wall portion 24 for infinite adjustment and/or shifting of the upper inker section 12 as desired. This mechanism includes a pivot arm 70 secured to shaft 66. An elongated, threaded rod 72 is pivotally secured to the end of arm 70 remote from shaft 66. This rod 72 is in turn threaded into and is advanceable with respect to a captive nut 74. Nut 74 is pivotal about a horizontal axis and is supported by a block 76 secured to wall portion 24. Finally, operating handle 78 is secured to the end of rod 72 remote from arm 70. As can be readily appreciated, rotation of the rod 72 through the medium of handle 78 causes corresponding movement of pivot arm 70 and shaft 66; this in turn pivots the entire inker section 12 about the axis defined by the shaft 66.

Printer section 14 includes a pair of laterally spaced, roller-supporting sidewalls 80, 82 which rest atop the upper margins of the corresponding wall portions 22, 24. These sidewalls are relatively thick, e.g., 1½ inch steel, inasmuch as the relatively heavy printer section must be adequately supported to achieve the best possible printing results. The printer section 14 in this instance includes a pair of blanket rollers 84 and 86 having resilient peripheries which are disposed generally one atop the other (see FIG. 5) and cooperatively present a web contacting and printing nip area therebetween. As shown, the blanket rollers 84, 86 define a nip area for receiving a web 88 traveling along a generally horizontal path of travel; thus, the printer module 14 presents a so-called straight-through perfector tower wherein both faces of the web 88 are imprinted simultaneously during passage through the printer section, and moreover the web 88 travels along a generally horizontal path of travel through the tower 10. The section 14 also includes a pair of plate-supporting cylinders or rollers 90, 92 which are respectively in tangential rolling contact with a corresponding blanket cylinder 84, 86 as illustrated.

Lower inker section 16 is substantially identical with the previously described section 12. The section 16 includes a pair of laterally spaced, roller-supporting sidewalls 94, 96 of ¾ inch steel which are each pivotally mounted to the corresponding main frame sidewall portion 22, 24 by means of respective pivot pins 98, 100. The sidewalls are configured to present respective keyhole slots 101 which support the relatively large, resilient form roller 102. These walls also support rider roller 104, and vibrator rollers 106 and 108, in tangential rolling contact with form roller 102. In addition, the sidewalls 94, 96 support the respective rider roller sets each including the rollers 110, 112 and 114. As best seen in FIG. 5 however, the main frame portions 22, 24, support the ink fountain 116, ink roller 118, shiftable ductor rollers 120, 122, and the vibrator roller 124. Thus, although the overall upper and lower inking systems are essentially identical, in the case of the lower inker section 16, only the described portion thereof is mounted on the modular sidewalls 94, 96.

This modular portion of the overall lower inking system is shiftable by virtue of mechanism 126 (see FIG. 5). Mechanism 126 includes a pneumatic piston and cylinder assembly 128 having a cylinder 129 and piston rod 130 extending therefrom. The rod 130 is threaded into a collar 132 so as to allow adjustment of the effective length of the rod 130. The collar 132 is in turn pivoted to a depending tab 134 which is integral with the sidewall 96. The cylinder 129 is pivotally mounted to an arm 136. The arm 136 is pivotal about a horizontal axis defined by a pivot pin 138, the latter extending through the wall portion 24. A gear 140 is mounted on the pin 138 for rotation therewith. A worm gear 142, supported by the housing 144, is in intermeshed, driving engagement with gear 140. An elongated, rotatable rod 146 is secured to the worm gear 142, and has an operating handle 148 coupled thereto remote from the gear 142. In addition, a pair of adjustable, threaded limit stops 149 are mounted on wall 94 to facilitate proper positioning of the section 16.

Upper water system 18 is disposed below upper inker section 12 and in side-by-side relationship to printer section 14. The water system 18 includes a pan 150 for holding a supply of dampening fluid such as water, and a pair of cylindrical, tangentially contacting rollers, respectively referred to as a metal pan roller 152 and a rubber intermediate roller 154, both partially submerged within the fluid held in the pan 150. In addition, a metal transfer roller 156 is provided, along with a dampening form roller 158 having a resilient periphery in tangential contact with both the roller 156 and the adjacent plate roller 90. The system 18 serves to deliver a continuous and uniform supply of dampening fluid in desired amounts to the corresponding plate roller 90 whereby the hydrophilic portions of the lithographic plate mounted on the roller 90 are constantly coated with a film of dampening fluid as required for high quality lithographic printing. Lower water system 20 is essentially identical with the system 18 and includes a pan 159, pan roller 161, intermediate roller 160, transfer roller 162 and dampening form roller 164.

The components of the respective upper and lower modular water systems 18, 20 are each mounted in shiftable drawer-like carriage structure 166, 168 for lateral movement of the entire system as desired. Air cylinders (not shown) are employed for assistance in shifting the upper and lower water systems into and out of the tower 10.

As those skilled in the art will readily appreciate, drive means are provided for driven rotation of at least certain of the rollers within the respective modules of tower 10. In practice, a single drive means is employed to drive, through appropriate gear trains, the plate and blanket rollers of printer section 14, and the form roller and vibrator rollers of the inker sections (the inking rollers of the upper and lower inkers 14 and 16 are friction driven by the gear-driven rollers). Also, the shiftable ductor rollers 44, 46 and 120, 122 are driven for back-and-forth oscillating movement, and the respective vibrator rollers are, in addition to axial rotation, driven for axial reciprocation. Finally, separate drive and gearing arrangement is provided for the upper and lower water systems 18 and 20.

Figure 6:
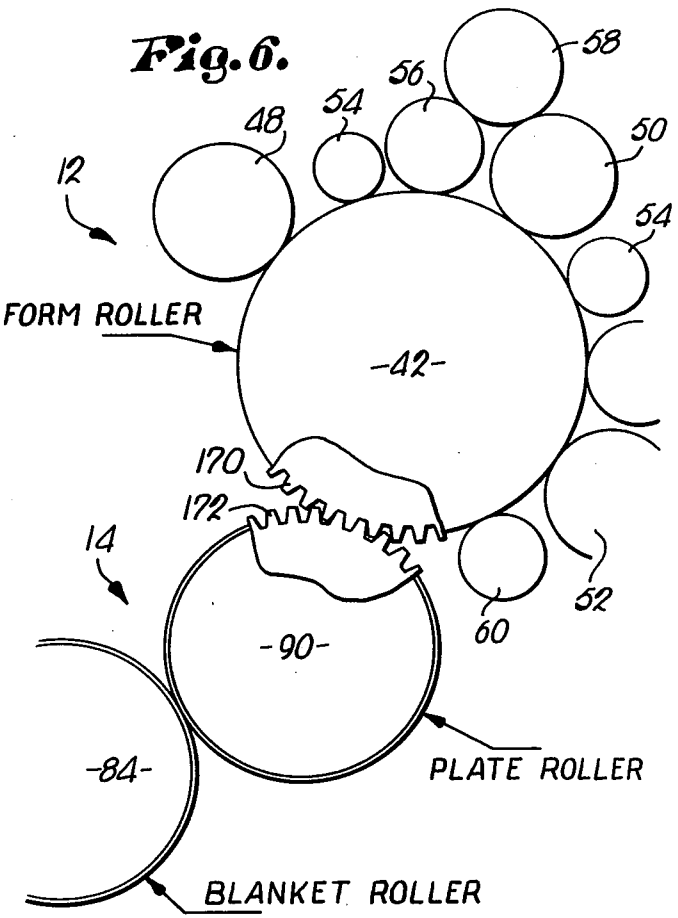
FIG. 6 is an enlarged, essentially schematic view illustrating the contact between the plate roller of a first printer module and the form roller of the upper inker module.

Referring now to FIG. 6, an enlarged, fragmentary, essentially schematic illustration of the lower portion of upper inker module 12, and the upper portion of printer module 14, is illustrated. In this regard, the single form cylinder 42 is shown, along with the drive gear 170 associated therewith. Also, the drive gear 172 associated with the plate roller 90 is illustrated. The gears 170 and 172 are in intermeshed, driving engagement, and it is important to note in this respect that the pitch diameter of gear 170 is essentially identical with the diameter of form cylinder 42, and the pitch diameter of gear 172 is essentially identical with the effective diameter of plate roller 90 in use, e.g., the total diameter of the plate roller and a plate secured therearound. Hence, intermeshing of the gears 170, 172 serves to place the periphery of the rollers 42, 90 in tangential, rolling contact with each other.

Figure 7:
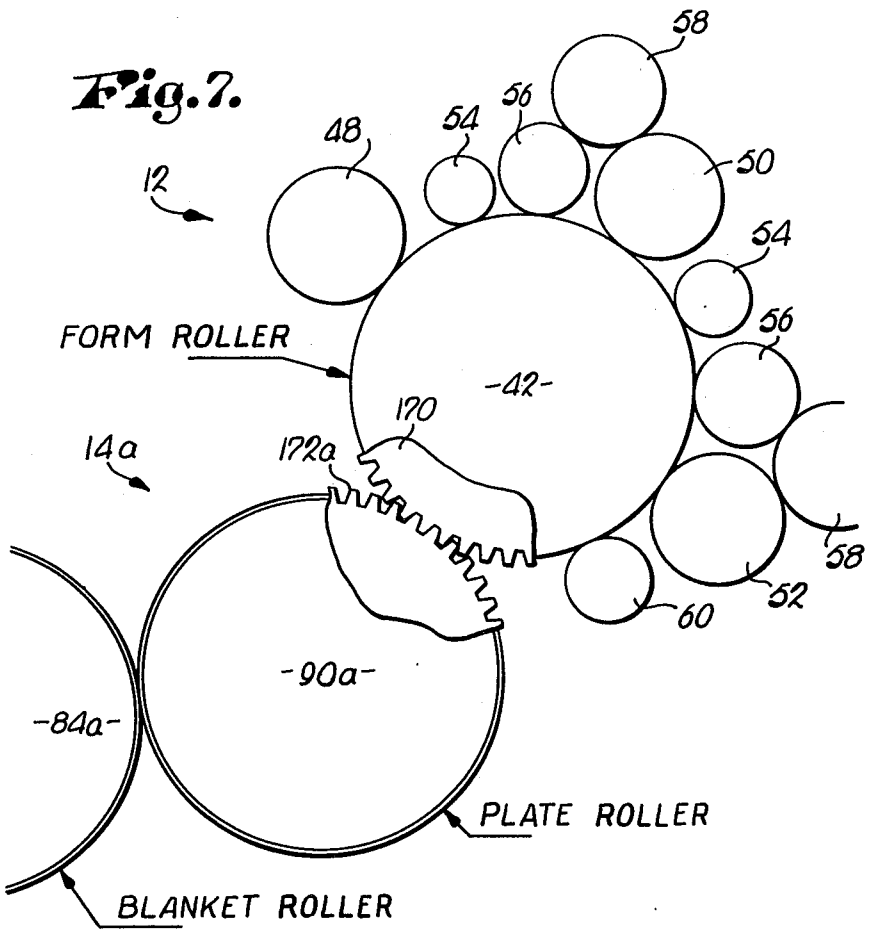
FIG. 7 is a view similar to FIG. 6 but illustrating the use of a second printer module having a plate roller larger than that of the first printer module.

As noted above, inker sections 12 and 16 employ only a single form roller in tangential contact with the adjacent plate roller. This in turn allows replacement of the printer section 14 with a second section **14*a* having a plate roller and blanket roller of different diameters. This situation is illustrated in FIG. 7 wherein a printer section 14*a* is employed having a plate roller 90*a* of greater effective diameter than that of the roller 90 illustrated in FIG. 6. Here again however, the pitch diameter of the gear 172*a* associated with roller 90*a* is essentially equal to the effective diameter of the roller 90*a* during use thereof. Hence, proper intermeshing contact can be established between gear 170 associated with roller 42, and the gear 172*a* associated with plate roller 90*a***.

Typical prior inker units have employed a plurality of ink-transferring form rollers in contact with a single plate roller. As can be appreciated, this sort of construction makes changing the plate roller a very difficult task, since the position of all of the associated form rollers must also be altered. However, the single form roller employed in the present invention, along with the described gearing arrangement, eliminates the need for roller position alteration and thus greatly facilitates tower changeovers.

During normal printing operations with the tower 10, web 88 passes between the blanket rollers 84, 86 and is printed on both sides thereof. As explained, upper printer section 12 serves to supply ink to the plate-supporting roller 90, and upper water system 18 supplies a dampening supply of water to the roller 90 as well. In a similar fashion, lower inker section 16, along with lower water section 20, supply the plate-supporting roller 92. The specific function of the various rollers making up the respective sections or modules of tower 10 are well known to those skilled in the art, and thus need not be discussed in detail herein. However, in the event that it is necessary or desirable to throw off upper inker section 12, a piston and cylinder assembly (not shown) can be activated to disengage form roller 42 from plate roller 90 without disengaging the associated gears. In a similar manner, minimum disengagement of lower inker section 16 is effected through the piston and cylinder assembly 128 which serves to pivot form roller 102 out of tangential contact with the adjacent roller 92. These mechanisms provide an easy and efficient "form on and off" function for the tower 10. It will also be recognized that the adjustability of the respective inker sections 12 and 16 relative to printer section 14 makes it a simple matter to precisely position the inkers in the field, notwithstanding any minor tolerance errors which might have been made during fabrication. Silencing of the inker sections can be effected by rotation of the handles 78, 148 so as to disengage the gears between the respective form rollers and plate rollers.

In the event that it is desired to change printer section 14, tower 10 is shut down and handle 78 is manipulated so as to rotate upper inker section 12 to a retracted, printer section-clearing position best illustrated in FIG. 4. In this orientation, the entire printer section 14 can be lifted essentially vertically out of tower 10. This is normally accomplished through the use of overhead support rails or portable gantries commonly found in print shops. Furthermore, the respective rollers of upper inker section 12 can be inspected and replaced when the section 12 is in its retracted position. This is particularly the case with respect to form roller 42 which is mounted within the keyhole slot 61 as described.

When printer section 14 is removed from tower 10, easy access is provided to the lower inker section 16, and particularly to the form roller 102. The latter is mounted within the respective keyhole slots 101, and can be replaced as needed without difficulty. As noted above, precise adjustment of the orientation of the modular portion of section 16 can be effected through piston and cylinder assembly 128 and the adjustable limit stops 149.

In the event that it is desired to employ a new printer section, it is only necessary to place the new printer section into position on tower 10 and secure the same by conventional means (not shown). Tower 10 is particularly suited for use of printer sections having varying sizes of plate rolls, and the single inker form roll construction greatly facilitates changeover of printer sections. After the new printer section is installed, upper inker section 12 is pivoted back to its normal operating position. By virtue of the fact that there are only two points of tangency on the plate roller, (from the dampening form roller and inker form roller) any practical size of plate roller can be employed.

The water delivery systems 18 and 20 can be removed by laterally shifting the same out of the tower. To this end the systems are constructed as separate units and are mounted on rails for support purposes. Here again, replacement of one or more of the water systems can be effected simply by use of a new system.

It will also be appreciated that the particular printing tower herein described in detail can be modified in many respects without departing from the spirit and scope of the invention. For example, although a perfector tower has been described and depicted, it will be understood that, where desired, web 88 can be printed only on one side thereof. In these circumstances, a printer section having upper blanket and plate rollers, and a lower impression roller adjacent the blanket roller, is used. Moreover, a printing tower can be constructed which omits the modular components necessary for perfecting printing.

Having thus described the invention, what is claimed as new and desired to be secured by Letters Patent is:

1. A web printing tower, comprising:

a pair of spaced apart main sidewalls each having an upper margin;

a modular printer section removably supported by said main sidewalls and including a pair of spaced apart printer sidewalls separate from said main sidewalls, each of said printer sidewalls having a lower margin complemental with a portion of a corresponding main sidewall upper margin for complementally and abuttably engaging said upper margin portion, whereby the printer section is situated generally atop and supported by said main sidewalls;

an elongated, cylindrical plate roller;

an elongated, cylindrical web-contacting blanket roller;

an elongated, cylinder; and means for mounting said plate and blanket roller between said printer sidewalls in tangential contact with each other and for axial rotation of the plate and blanket rollers;

means for axially rotatably mounting said cylinder between said printer sidewalls and adjacent and generally below said blanket roller to define a web-receiving nip between the cylinder and blanket roller for a web traveling generally horizontally through said tower;

an inker section including spaced apart inker sidewalls separate from said main sidewalls and printer sidewalls, a single, elongated, cylindrical, axially rotatable inker form roller supported by said inker sidewalls, and means for continuously applying ink to the periphery of said inker form roller during printing operations of said tower;

means for mounting said inker section on said tower with said inker sidewalls abuttably engaging said main sidewalls and in a normal position above said printer section, with said single form roller in ink-transferring engagement with said plate roller, and for selective pivoting of the inker section about a generally horizontal axis from said normal position to a retracted printer section-clearing position permitting said printer section to be bodily moved upwardly out of said tower without obstruction from the inker section and while said inker section remains secured to said tower, said upward movement of said printer section being generally transverse to the horizontal direction of travel of said web through said tower, said single inker form roller being the sole inking roller in engagement with said plate roller when said inker section is in said normal position thereof;

means for rotating said rollers and said cylinder including respective spur gears drivingly coupled to said single form roller and plate roller and configured for meshed, driving interengagement when said inker section is in said normal position thereof;

the pitch diameter of the spur gear coupled to said inker form roller being substantially the same as the diameter of the inker form roller, and the pitch diameter of said spur gear coupled to said plate roller being substantially the same as the effective diameter of the plate roller, whereby said tower can accommodate replacement printer sections having different diameter plate and blanket rollers without modification of said inker section.

2. The tower as set forth in claim 1 wherein said printer section sidewalls and said inker section sidewalls are of different thicknesses.

3. The tower as set forth in claim 1, said cylinder comprising another web-contacting blanket roller disposed with said first-mentioned blanker roller for simultaneous contact and printing on both sides of said web.

4. The tower as set forth in claim 1, including a water supply module removably supported by said tower and having means for applying water to said plate roller.

* * * * *